United States Patent [19]

Cairns et al.

[11] 4,227,761

[45] Oct. 14, 1980

[54] FUSE HOLDER WITH ENTRY CONTROL

[75] Inventors: Thomas M. Cairns, Birmingham; John H. Dewar, Grosse Ile; Emmons F. Sumner, Ann Arbor, all of Mich.

[73] Assignee: Ford Motor Company, Dearborn, Mich.

[21] Appl. No.: 16,468

[22] Filed: Mar. 1, 1979

[51] Int. Cl.[3] ..... H01R 13/631

[52] U.S. Cl. ..... 339/66 M; 339/717 S; 339/262 F

[58] Field of Search ..... 339/147 R, 147 P, 217 R, 339/217 S, 126 R, 186 R, 186 M, 198 K, 198 S, 219 F, 134, 113 R, 113 B, 189 R, 189 M, 66 R, 66 M, 258 F, 262 F, 154 R, 154 A; 337/198; 361/426, 430, 431, 357, 360, 347, 348

[56] References Cited

U.S. PATENT DOCUMENTS

| | | | |
|---|---|---|---|
| 2,831,087 | 4/1958 | Sundt | 200/133 |
| 2,851,671 | 9/1958 | Luce | 339/150 |
| 2,955,178 | 10/1960 | Lander et al. | 200/133 |
| 3,060,293 | 10/1962 | Lapidus | 200/133 |
| 3,226,668 | 12/1965 | Baer et al. | 339/217 S |
| 3,253,252 | 5/1966 | Piperato et al. | 339/198 |
| 3,634,812 | 1/1972 | Genova | 339/258 F X |
| 3,775,723 | 11/1973 | Mamrick et al. | 337/245 |
| 3,775,724 | 11/1973 | Mamrick et al. | 337/245 |
| 3,848,951 | 11/1974 | Michaels et al. | 339/91 R |
| 3,851,224 | 11/1974 | Ege | 339/219 F X |
| 4,080,039 | 3/1978 | Ahroni | 339/147 R |
| 4,097,109 | 6/1978 | Cross | 339/258 F X |

*Primary Examiner*—Richard B. Lazarus
*Assistant Examiner*—Eugene F. Desmond
*Attorney, Agent, or Firm*—Peter Abolins; Clifford L. Sadler

[57] ABSTRACT

This specification discloses an automobile terminal block for receiving fuses, and electrical connections to various electrical components of the automobile. The terminal block has a passage extending therethrough for receiving a fuse holder which is mounted within the terminal block. The fuse holder is adapted to receive the blade contact of a fuse thereby electrically connecting the fuse to the fuse holder. Typically, the fuse holder has a spring clip with two prongs spring biased against one another so that the blade can be resiliently secured between the two prongs. The terminal block includes an entry control ledge for guiding the blade contacts of the fuse toward the fuse holder. The entry control ledge extends from the sides of the passage in a position aligned with the spring clip so that the blade contact can be guided between the prongs of the spring clip and does not enter the region between the prongs and the walls of the passage. An entry control ramp can extend above the entry control ledge and provides both a securing influence and a guiding force on the body of the fuse. The upper face of the prongs positioned toward an incoming blade contact can be angled so that the blade contact striking the upper face is guided toward a position between the prongs.

3 Claims, 6 Drawing Figures

FUSE HOLDER WITH ENTRY CONTROL

BACKGROUND OF THE INVENTION (1) Field of the Invention

This invention relates to electrical connectors; and, more particularly, to a terminal block which removably secures various connections.

(2) Prior Art

Automobiles typically have a fuse terminal block which is mounted adjacent the instrument panel or forward fire wall to provide a means for securing fuses and for providing connections to various electrical components of an automobile such as headlights, horns, power seats, power windows and numerous other electrical options which can be customer selected on automobiles.

It is particularly desirable that the fuses can be rapidly and securely connected to the terminal block. Advantageously the system should be completely "fool proof" to satisfy the needs of rapid and simple mass production of automobiles as well as facilitating repair of any faults in the terminal block or replacement of fuses. Because of the desire of either the assembler or the repairer to use "short cuts" or to otherwise complete the job as quickly as possible without adequate assurance of quality of the completed apparatus, designing a secure entry of the fuse into the terminal block has presented problems.

For example, in one known system shown in FIG. 3 of U.S. Pat. No. 4,097,109, the fuse holder is inserted into a cavity in the terminal block and the tops of the two prongs of the spring clips of the fuse holder extend above the opening edge of the cavity. The tops of the prongs appear semicircular and the edge of the cavity is sufficiently spaced from each prong so that a blade contact from a fuse could easily be inserted between the wall of the cavity and the spring clip. Such an insertion is undesirable because the blade contact is not as securely held in place as it would be were the blade correctly positioned between the two prongs of the spring clip. This is a very difficult fault to detect because an electrical connection is made and the fuse operates in an apparently normal fashion. However, when the automobile is driven and the terminal block is exposed to vibrations, such fuses have a much greater possiblity of causing problems. For example, there may be an intermittent contact, which is particularly difficult to isolate. The fuse may fall out and break the contact thus making inoperable an electrical system within the motor vehicle. Such an inoperative electrical system will at least cause customer dissatisfaction and may present a safety hazard. Still further, the fuse is substantially held in the terminal block by only the friction between the blade contacts and the prongs. Thus, the force holding the fuse in is limited by the common area between the blade contacts and the prongs. These are some of the problems this invention overcomes.

SUMMARY OF THE INVENTION

This invention recognizes that a passage within a terminal block can have entry control means for guiding in the blade contacts of the fuse toward a fuse holder with the terminal block. The fuse holder is secured within the passage so that when the blade contacts of the fuse are inserted into the passage a correct electrical connection is established. The fuse holder includes a spring clip with two mirror image prongs folded back on themselves so that the blade contact to the fuse can be held resiliently between the prongs. The entry control means extends from each side of the passage over at least a portion of each of the two prongs so that the blade contacts of the fuse are guided between the prongs and prevented from entering the region between the passage wall and one of the prongs thereby insuring a good connection.

An embodiment of this invention can also include entry control means which extend sufficiently in the direction of fuse insertion travel to abut the sides of the fuse when the fuse is in place. Not only is there an improved guiding capability during fuse insertion, but there is securing influence on the fuse.

Thus, both an assembler and a repairer who must insert fuses is relieved of the burden of making sure that the blade contact enters between the prongs and not between the prong and the passage wall. Visual inspections are often difficult and the initial feel of the insertion of the blade contact may be about the same either between the prongs or between the prong and the cavity wall. Essentially, insertion of the blade contact is limited to insertion in the desired position between the prongs. As a result, both speed of assembly and reliability of assembly are improved in accordance with an embodiment of this invention. As is well known, an improved reliability of assembly results in fewer repairs and less dissatisfaction as a result of faults caused by assembly. Such a design facilitates automated insertion of fuses.

DETAILED DESCRIPTION OF THE INVENTION

Figure 1:
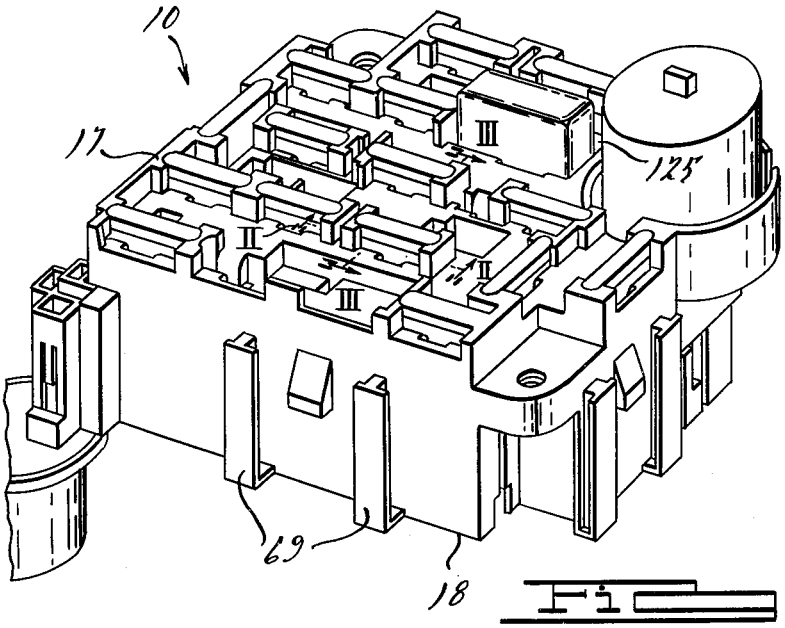
FIG. 1 is a perspective view of a terminal block in accordance with an embodiment of this invention including fuses positioned in passages for receiving fuses.
Figure 2:
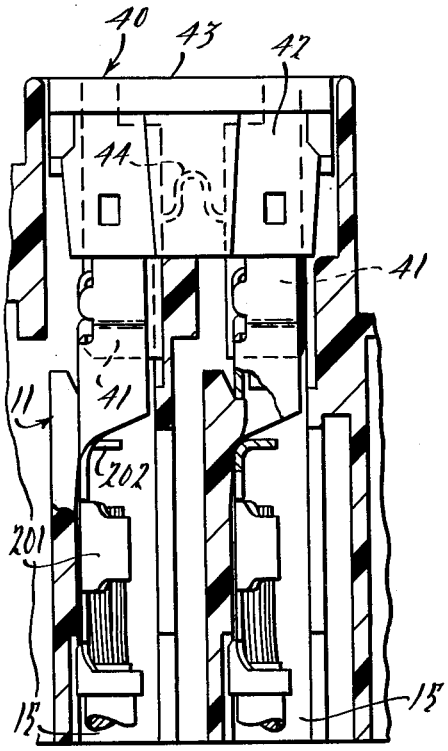
FIG. 2 is a partial section view taken along line II—II of FIG. 1.
Figure 3:
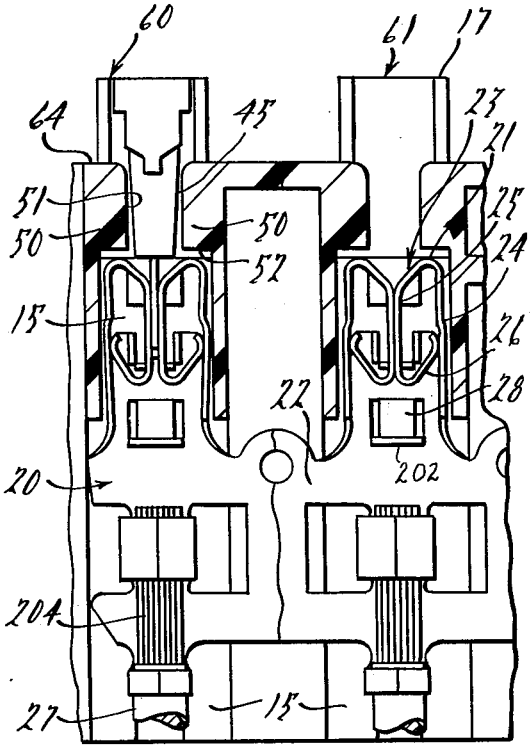
FIG. 3 is a partial section view along line III—III of FIG. 1 including a view of the terminal block extending over a portion of the prongs of the spring clip.

Referring to FIG. 1, a terminal block 10 has the general shape of a rectangular solid with a plurality of passages 15 extending therethrough between a front (or top) surface 17 and a rear (or bottom) surface 18. At least some of passages 15 from top surface 17 of terminal block 10 are designed to receive a fuse 40 having a pair of spaced blade contacts 41. Fuse 40 is advantageously a miniature plug-in fuse similar to that described in U.S. Pat. No. 3,909,767 issued Sept. 30, 1975 and assigned to Littlefuse, Inc. At least some of passages 15 are accessible from bottom surface 18 of terminal block 10 and are adapted to receive a fuse holder 20 as shown in FIGS. 2 and 3. Further, various accessory connections can be made from the bottom and the top of terminal block 10 to a bus bar 22 of fuse holder 20 or, in some cases, directly to blade contacts 41 of fuse 40.

Fuse holder 20 has a longitudinally extending bus bar 22 having laterally extending spring clips 23, each having a pair of prongs 21. Fuse holder 20 typically has a plurality of spring clips 23 along its length and at least a pair of attaching prongs 201 for connecting to an electrical lead 27. Prongs 21 have an outside portion 24, an intermediate portion 25 and an end portion 26 (FIG. 3). Between outside portion 24 and intermediate portion 25 there is a fold or bend and there is another fold or bend between intermediate portion 25 and end portion 26. Accordingly, spring clip 23 comprises two prongs 21 which are folded back on themselves twice so that the end portions 26 of each prong 21 bear resiliently against the outside portions 24 and the intermediate portions 25 of the two prongs 21 bear against each other. Advantageously, intermediate portion 25 extends down at an angle of about 45° from the top of outside portion 24 until opposing intermediate portions 25 abutt.

In use, a blade contact 41 of fuse 40 is held resiliently between intermediate portions 25 of the two prongs 21 (FIGS. 2 and 3). Fuse holder 20 also includes an opening 28 associated with each spring clip 23 which acts in cooperation with a portion of terminal block 10 to secure fuse holder 20 in terminal block 10. Fuse holder is advantageously made in a progressive die from a blank i.e., an elongated piece of sheet metal, so there results a long strip of spring clips 23 which can be rolled into a reel for storage.

Fuse 40 is a relatively small, flat element which includes a flat sheet metal stamping 42 partially situated within a plastic housing 43 (FIG. 2). Stamping 42 includes a fuse element 44, and blade contacts 41 which are a pair of laterally spacing protruding contact elements which are to be received between prongs 21 of spring clip 23 which is part of fuse holder 20.

Additional description of the above described fuse terminal block assembly is found in the following copending applications filed on even date herewith, the disclosures of which are hereby incorporated by reference: Title of I—Terminal Block With Electrical Connection Means With Connector Location Wall and Locking Finger, Ser. No. 16,469. Title of III—Fuse Terminal Block With Alternative Means For Connecting Two Fuse Blades, Ser. No. 16,474. Title of IV—Terminal Block With Fuse Guards and Identification Surface, Ser. No. 16,473, Title of VI—Fuse Holder with Insertion Ramp, Ser. No. 16,579.

This invention is directed toward an entry control ledge 50 (FIG. 3) which extends from each side of passage 15 in a direction perpendicular to the plane defined by the abutment of prongs 21 with each other. Accordingly, outside portions 24 of each prongs 21 are guarded or covered from above by entry control ledge 50. Entry control ledge 50 extends sufficiently along the aforementioned plane in a direction lateral to the insertion of fuse 40 so as to shield substantially the entire width of spring clip 23.

With the presence of entry control ledge 50 even a careless insertion of fuse 40 insures that blade contacts 41 cannot enter the region between outside portion 24 of prongs 21 and the wall of passage 15. In particular, as shown in FIG. 3, the control ledge 50 insures that blade contact 41 enters passage 15 at a position only between intermediate portions 25 of prongs 21. As a result, both the speed of assembly and replacement of fuses 40 can be increased while providing for substantially fool proof system insuring that the blade contacts 41 are positioned between the wall of passage 15 and intermediate portion 25. Such a fault can be particularly troubling because it is difficult to locate or may be intermittent in nature. Further, inspection of the fuse itself would indicate that the fusing link is operating properly.

Entry control ledge 50 can extend upward so that there is an insertion guide face 51 (FIG. 3) facing inward within passage 15. Fuse 40 includes a pair of opposing indentations 45 at each of the ends of fuse 40 which are laterally spaced from one another a distance equal to the spacing of insertion guide face 51. The uppermost portion of insertion guide face 51 is curved so that a blade contact 41 striking it is guided towards the area between opposing insertion guide faces 51. When fuse 40 is inserted into terminal block 10 insertion guide faces 51 fit snugly against indentation 45 of fuse 40 so that there is improved retention. Referring to FIG. 3, ledge 50 includes a horizontally extending ledge bottom 52 which is positioned sufficiently down in passage 15 to act as a stop for the insertion movement of fuse holder 20 into passage 15 of terminal block 10. That is, when the uppermost bend in fuse holder 20 hits ledge bottom 52, forward motion of fuse holder 20 stops.

Figure 4:
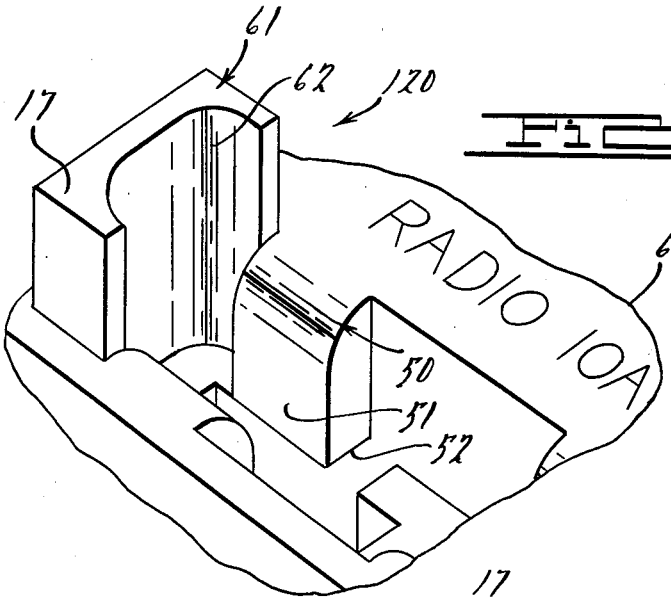
FIG. 4 is a perspective view of a passage opening including an entry control ledge and insertion guide face.
Figure 5:
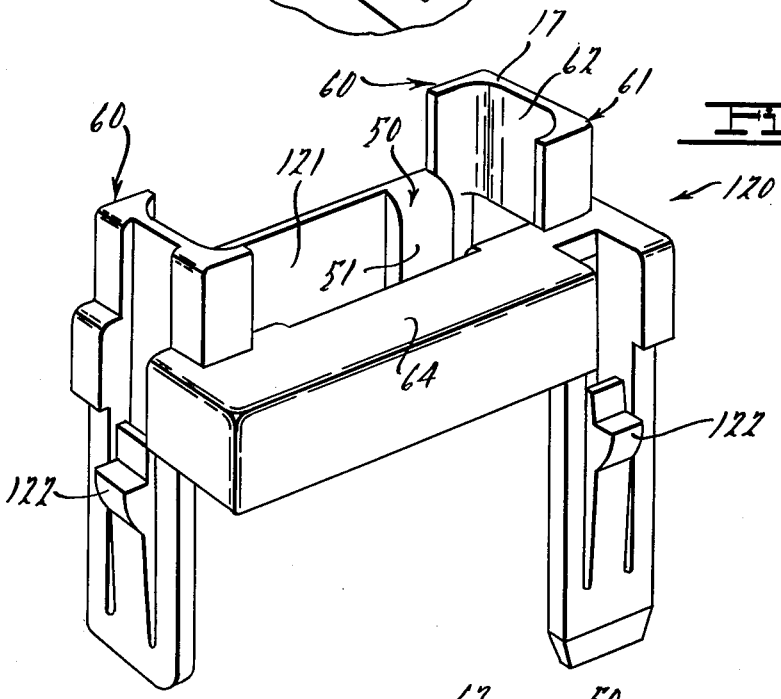
FIG. 5 is a perspective view of a connector body for adapting a circuit breaker opening to a fuse opening, and including an entry control ledge and insertion guide face.
Figure 6:
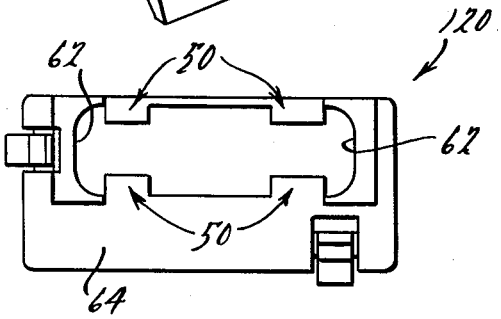
FIG. 6 is a top plan view of the connector body of FIG. 5.

A connector body 120 has a main portion shaped as a rectangular solid with a central opening 121 therethrough (FIGS. 4, 5 and 6). Terminal block 10 includes a cavity or socket 125 (FIG. 1) adjacent the upper opening of a passage 15 suitable for receiving connector body 120 or a circuit breaker. Opening 121 is suitable for receiving a fuse so that associated passage 15 can be used in conjunction with a circuit breaker when connector body 120 is removed from cavity 125 and can be used in conjunction with a fuse 40 when connector body is positioned in cavity 125. Extending downward from the main portion of connector body 120 is a pair of locking fingers 122 including protrusions 123. Cavity 125 includes recesses (not shown) for releasably mating to locking fingers 122. The inwardly facing surface of central opening 121 has entry control ledge 50 for guiding the blade contacts of the fuse and applying a securing effect to the body of the fuse when positioned in terminal block 10.

Referring to FIGS. 3, 4, 5 and 6, a fuse guard 60 extends from an identification surface 64 of terminal block 10. Fuse guard 60 includes a pair of spaced, generally semicircular end portions 61 having curved interior surfaces 62 which abut the ends of fuse 40 and are shaped to conform to the ends of fuse 40. The top surface 17 of fuse guard 60 extends substantially to the height of the top of fuse 40 when fuse 40 is inserted into terminal block 10. The exterior surface of fuse guard 60 is made of three perpendicular planes which facilitate close placement of fuse guards 60 and therefore dense packing of fuses 40.

An identification surface 64 extends laterally from the base of fuse guard 60. That is, identification surface 64 extends out from the top of passage 15 and is parallel to top surface 17. The identification surface 64 for a particular fuse is positioned adjacent a line connecting the two portions of fuse guard 60 for that fuse.

Terminal block 10 is molded of a plastic material. A typical spacing between the closest edges of opposing ledges is about 0.13 inches. A typical lateral spacing between adjacent ledges is about 0.3 inches. A typical width of a ledge extending outward from the wall of the passage toward the other ledge is about 0.075 inches; and a typical height is about 0.25 inches.

Various modifications and variations will no doubt occur to those skilled in the various arts to which this invention pertains. For example, the size and thickness of the ledge may be varied from those described herein. These and all other variations which basically rely on the teachings through which this disclosure has advanced the art are properly considered within the scope of this invention.

We claim:

1. A fuse terminal block assembly having a terminal block with a passage containing a fuse holder so that a blade contact of a fuse can be inserted into said passage for connection to said fuse holder;

said passage having an entry control means for guiding the blade contact of the fuse toward the fuse holder;

said fuse holder including a spring clip with two mirror image prongs folded back on themselves so that the blade contact of the fuse can be held resiliently between the two prongs;

said entry control means extending from each side of said passage over at least a portion of each of said two prongs so that the blade contact of the fuse is guided between the two prongs thereby insuring a good electrical connection and is prevented from entering the region between the passage wall and one of the prongs; and a connector body with a central opening having therein said entry control means, said connector body being removable from said terminal block so that there is provided a cavity sufficiently large for the insertion of a circuit breaker with blade contacts reaching the same contact points in said fuse holder as a fuse which is associated with said entry control means in said connector body.

2. A fuse terminal block assembly as recited in claim 1 wherein said connector body has sufficient height so that said entry control means associated with said connector body can provide an insertion guide for the body of the fuse inserted into said terminal block and apply a lateral securing influence on the body of the fuse when the fuse is positioned in the terminal block;

said connector body further comprising locking fingers extending downward, in a direction generally parallel to the direction of insertion of the fuse; and said terminal block including a latch means for receiving said protrusions thereby releasably securing said connector body as a part of said fuse terminal block assembly.

3. A fuse terminal block assembly having a terminal block with a passage containing a fuse holder so that a blade contact of a fuse can be inserted into said passage for connection to said fuse holder;

said passage having an entry control means for guiding the blade contact of the fuse toward the fuse holder;

said fuse holder including a spring clip with two mirror image prongs folded back on themselves so that the blade contact of the fuse can be held resiliently between the two prongs;

said entry control means extending from each side of said passage over at least a portion of each of said two prongs so that the blade contact of the fuse is guided between the two prongs thereby insuring a good electrical connection and is prevented from entering the region between the passage wall and one of the prongs;

a support means extending above the top surface of said passage so as to partially surround a fuse inserted into said passage thus providing protection against accidental removal of the fuse from said passage and yet exposing a portion of said fuse to facilitate intentional removal of the fuse from said passage;

an identification surface extending generally perpendicular to the direction of extension of said support means, said identification surface extending generally laterally away from the top of said passage for providing a surface for displaying information about the fuse to be placed in said passage; and said support means including a pair of spaced fuse guards, each of said fuse guards being positioned adjacent a passage and being sufficiently spaced from one another so that a fuse can snugly fit therebetween and expose a portion of the fuse sufficient for grasping of the fuse.

* * * * *